US009460872B2

(12) United States Patent
Kirbawy

(10) Patent No.: US 9,460,872 B2
(45) Date of Patent: Oct. 4, 2016

(54) PLUNGER SWITCH AND METHOD OF OPERATING SAME

(71) Applicant: Delta Systems, Inc., Streetsboro, OH (US)

(72) Inventor: Isaac Kirbawy, Tallmadge, OH (US)

(73) Assignee: Delta Systems, Inc., Streetsboro, OH (US)

( * ) Notice: Subject to any disclaimer, the term of this patent is extended or adjusted under 35 U.S.C. 154(b) by 73 days.

(21) Appl. No.: 14/267,616

(22) Filed: May 1, 2014

(65) Prior Publication Data

US 2014/0332357 A1 Nov. 13, 2014

Related U.S. Application Data

(60) Provisional application No. 61/820,424, filed on May 7, 2013.

(51) Int. Cl.
*H01H 13/06* (2006.01)

(52) U.S. Cl.
CPC ..... *H01H 13/063* (2013.01); *H01H 13/06* (2013.01); *H01H 2013/066* (2013.01); *H01H 2219/062* (2013.01); *H01H 2239/03* (2013.01); *Y10T 29/49105* (2015.01)

(58) Field of Classification Search
CPC ..... H01H 2013/066; H01H 13/06; H01H 2223/002; H01H 9/04; H01H 2009/048
USPC ..... 200/302.1, 302.2, 334, 51.11, 531
See application file for complete search history.

(56) References Cited

U.S. PATENT DOCUMENTS

| | | | | |
|---|---|---|---|---|
| 6,121,561 | A * | 9/2000 | Sweeney | H01H 13/063 200/302.1 |
| 7,064,639 | B2 * | 6/2006 | Harvey | H01H 73/44 335/165 |
| 2005/0029081 | A1 * | 2/2005 | Nakade | H01H 13/183 200/61.76 |
| 2005/0121301 | A1 * | 6/2005 | Hall | H01H 3/0226 200/543 |
| 2006/0256510 | A1 * | 11/2006 | Nakasono | G07C 9/00944 361/679.02 |

* cited by examiner

*Primary Examiner* — Renee Luebke
*Assistant Examiner* — Ahmed Saeed
(74) *Attorney, Agent, or Firm* — Tarolli, Sundheim, Covell & Tumino LLP

(57) ABSTRACT

A plunger switch assembly and method of operation comprises a housing having an interior cavity for locating electronic components, a contact support movably located within the interior cavity. The contact support holds and moves at least one electrical contact that engages a corresponding contact located on a printed circuit board. The plunger switch assembly further includes an actuating member for moving the contact support and at least one electrical contact within the interior cavity of the housing, a carriage cover located over the housing for guiding the actuating member, and an active sealing arrangement for preventing debris from entering the housing.

16 Claims, 10 Drawing Sheets

PLUNGER SWITCH AND METHOD OF OPERATING SAME

CROSS REFERENCES TO RELATED APPLICATIONS

The following application claims priority under 35 U.S.C. §119(e) to U.S. Provisional Patent Application Ser. No. 61/820,424 filed May 7, 2013 entitled PLUNGER SWITCH AND METHOD OF OPERATING SAME. The above-identified application is incorporated herein by reference in its entirety for all purposes.

TECHNICAL FIELD

The present disclosure relates to electrical switches, and more particularly to a plunger switch assembly and method of operation. The plunger switch assembly includes an active sealing arrangement that prevents contamination to internal components.

BACKGROUND

Electrical switches using push button or plunger type switch actuators have many applications including use in automobile car doors, ignition circuits, power take-offs for lawn mowers and garden tractors, refrigerator doors, home appliances, and the like. These push buttons may be normally open, normally closed or a combination of the two.

It is possible to construct switches having more than two terminals, which combine the features of normally open and normally closed switches. For example, a "double-pole double-throw" switch behaves as a normally open switch and a normally closed switch in parallel operated by a single plunger. When the plunger is in a normal position, a pair of normally closed terminals is bridged and a pair of normally open terminals is isolated. Alternatively, when the plunger is moved to an actuated position, the normally open terminals are bridged and the normally closed terminals are isolated. A "single-pole double-throw" switch behaves like a double-pole double-throw switch in which one of the normally open terminals is coupled to one of the normally closed terminals. When the plunger is in the normal position, a common terminal is bridged with a normally closed terminal while a normally open terminal is isolated. Alternatively, when the plunger is in the actuated position, the common terminal is bridged with the normally open terminal while the normally closed terminal is isolated. Such switches can then be configured to communicate on a LIN or CAN bus.

Typically located within a housing supporting electrical switch are electrical components such as contacts, printed circuit boards, etc. that are adverse to contamination, such as water or debris. It is not uncommon for such electrical switches to be exposed to such harsh environments, especially those switches used on garden tractors.

Further discussion relating to the different switch constructions can be found in U.S. Pat. No. 5,528,007 entitled PLUNGER SWITCH AND METHOD OF MANUFACTURE that issued on Jun. 18, 1996 and assigned to the assignee of the present disclosure. U.S. Pat. No. 5,528,007 is incorporated herein by reference in its entirety.

SUMMARY

One example embodiment of the present disclosure includes a plunger switch assembly and method of operation comprising a housing having an interior cavity for locating electronic components, a contact support movably located within the interior cavity. The contact support holds and moves at least one electrical contact that engages a corresponding contact located on a printed circuit board. The plunger switch assembly further includes an actuating knob for moving the contact support and at least one electrical contact within the interior cavity of the housing, a carriage cover located over the housing for guiding the actuating knob, and an active sealing arrangement for preventing debris from entering the housing.

Another example embodiment of the present disclosure includes a switch assembly comprising a housing having an interior cavity for locating electronic components, a contact support movably located within the interior cavity. The contact support holds and moves at least one electrical contact that selectively electrically communicates with a corresponding region on a printed circuit board. The printed circuit board is fixedly located in a base of the housing. The switch assembly also includes an actuating knob for moving the contact support and the at least one contact within the interior cavity of the housing such that the moving results in selective communication with the printed circuit board. A carriage cover is located over the housing for guiding the actuating knob, and a thermoplastic active sealing arrangement is provided for preventing debris from entering the housing. The active sealing arrangement comprises a bellows that expands and contracts as the actuating knob is moved from a first position to a second position.

Yet another example embodiment of the present disclosure includes a method of assembling a switch assembly, the method comprises the steps of providing a housing having an interior cavity for locating electronic components and locating a movable contact support within the interior cavity. The contact support holds and moves at least one electrical contact that engages a corresponding contact located on a printed circuit board. The method also includes the step of providing an actuating knob for moving the contact support and at least one contact within the interior cavity of the housing, and locating a carriage cover over a portion of the housing for guiding the actuating knob. The method also includes the step of providing an active sealing arrangement for preventing debris from entering the housing.

In another example embodiment of the present disclosure, a switch assembly comprises a housing having an interior cavity for locating electronic components and a knob moveably located between positions within the housing such that when the knob changes positions, the desired state changes in the switch assembly. The switch assembly also comprises an active sealing arrangement fixedly attached to the knob, the active sealing arrangement includes a moveable bellows such that movement of the knob relative to the housing results in corresponding movement in the bellows of the active sealing arrangement.

BRIEF DESCRIPTION OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals refer to like parts unless described otherwise throughout the drawings and in which.

DETAILED DESCRIPTION

Referring now to the figures generally wherein like numbered features shown therein refer to like elements throughout unless otherwise noted. The present disclosure relates to electrical switches, and more particularly to a plunger switch assembly and method of operation. The plunger switch assembly includes an active sealing arrangement that prevents contamination to internal components. In one example embodiment, the switch assembly includes an integrally connected printed circuit board that is configured to support multiple electronic/electrical system architecture, and/or to display operation status with one or more LED's. In another example embodiment, the switch assembly comprises light pipes that allow for the passing of illumination from the circuit board to alert the operator of the operating state.

Figure 1:
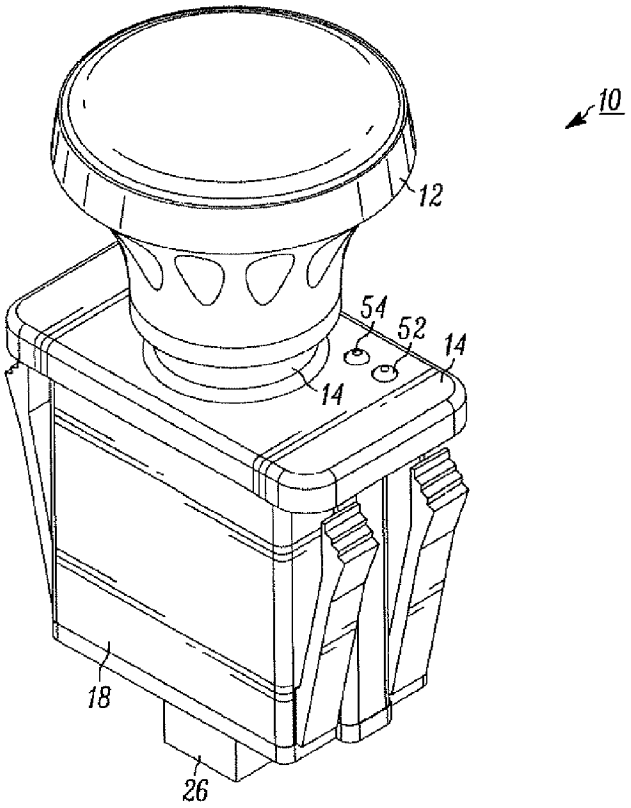
FIG. 1 is an upper perspective view of a plunger switch assembly constructed in accordance with one example embodiment of the present disclosure.
Figure 3:
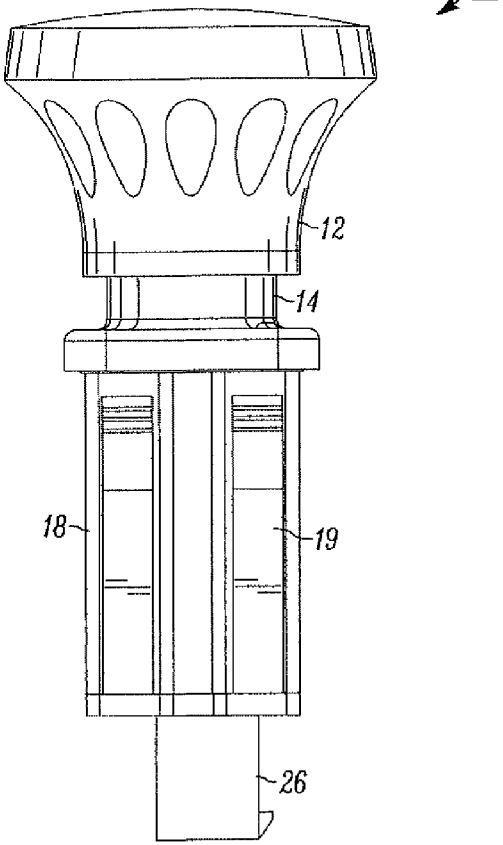
FIG. 3 is a side elevation view of FIG. 1.

FIG. 1 illustrates a perspective view of a plunger switch assembly 10 constructed in accordance with one example embodiment of the present disclosure. The switch assembly 10 as would be appreciated by one of ordinary skill in the art operates in both a normally open "NO" or normally closed "NC", single-pole double-throw, and double-pole double-throw configurations, based on the construction of the contact combinations with respective terminals, as further discussed below and in U.S. Pat. Nos. 5,528,007 and 5,221,816, which are incorporated herein by reference in their entireties. Such switches can then be configured to communicate on a LIN or CAN bus.

One application of the switch assembly 10 includes a power take-off for a lawn mower indirectly through an electronic control unit or directly, controlling the transfer of power from an engine output shaft to an accessory such as the lawn mower blades. In an alternative example embodiment, the switch assembly 10 includes in addition to normally open (NO) and normally closed (NC) positions, momentary or intermediate positions containing, both, neither, or one of the above positions for one or more terminals.

FIGS. 2-8 are further illustrative views of the plunger switch assembly 10 in accordance with the example embodiment of FIG. 1. The plunger switch assembly as best seen in the exploded view of FIG. 8 comprises an actuation member or knob 12, carriage 14, active sealing arrangement 16, housing 18, actuator assembly 20, printed circuit board 22, contact bridge 24, and base 26. In the illustrated example embodiment, the knob 12, carriage 14, housing 18, guide 24, base 26, and a portion of the actuator assembly 20 are made from molded plastic. It should be appreciated that other materials could be used instead of plastic of similar strength without departing from the spirit and scope of the present disclosure.

Figure 2:
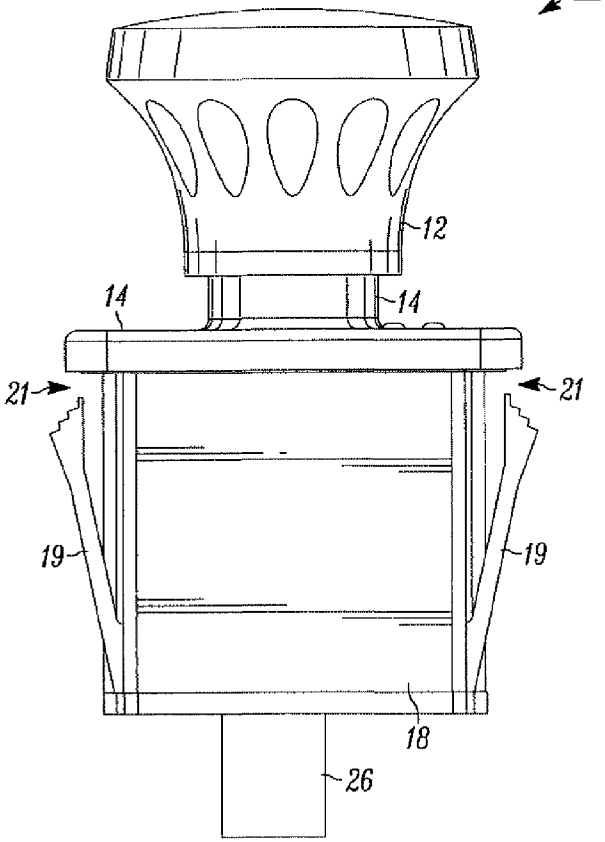
FIG. 2 is a front elevation view of FIG. 1.
Figure 5:
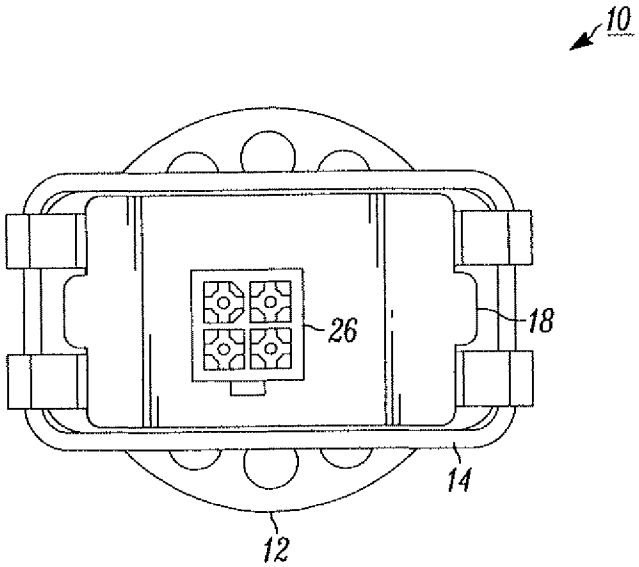
FIG. 5 is a bottom plan view of FIG. 1.
Figure 4:
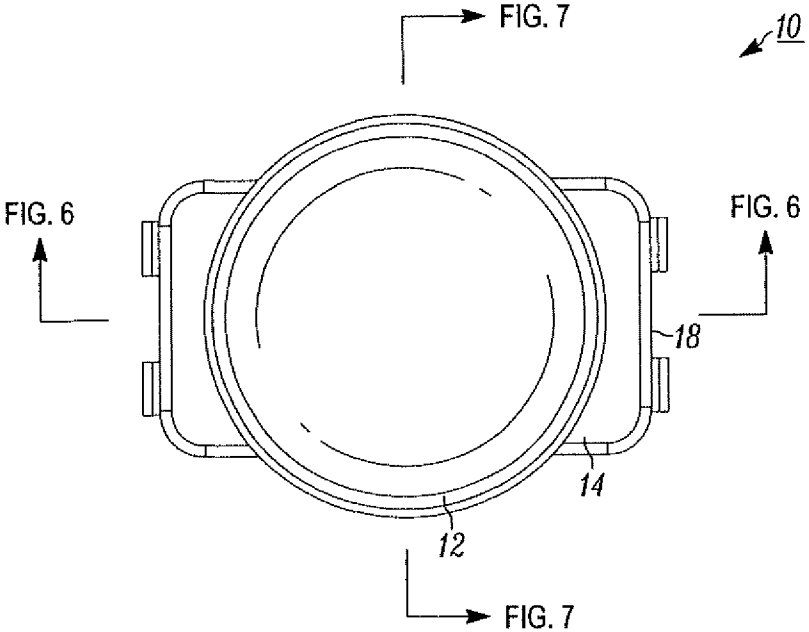
FIG. 4 is a top plan view of FIG. 1.

In one example embodiment, the plunger switch assembly 10 is constructed to be positioned or located within a dash panel of lawn tractor. The housing 18 includes wing-clips 19 that expand and contract when the switch is positioned within a dash panel opening, such that the wings compress as they pass through the opening, projecting outward once travel beyond the opening occurs. The dash panel then resides in a gap 21 between the carriage and wings 19 as illustrated in FIG. 2.

The housing 18 includes an interior cavity 23. The interior cavity supports electronic components 25 that includes the PCB 22 and its associated wipers and contact terminals.

Figure 7:
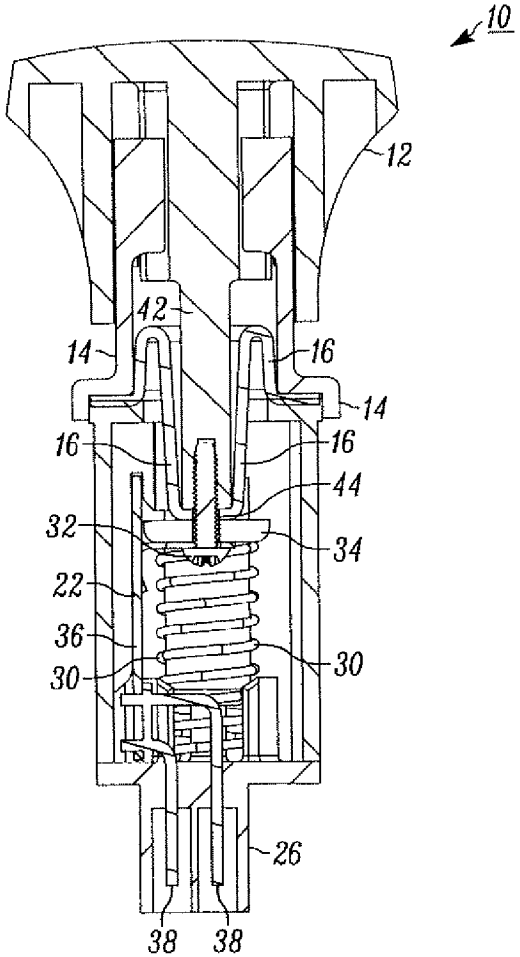
FIG. 7 is a side sectional elevation view of FIG. 1 about section lines 7-7 illustrated in FIG. 4
Figure 6:
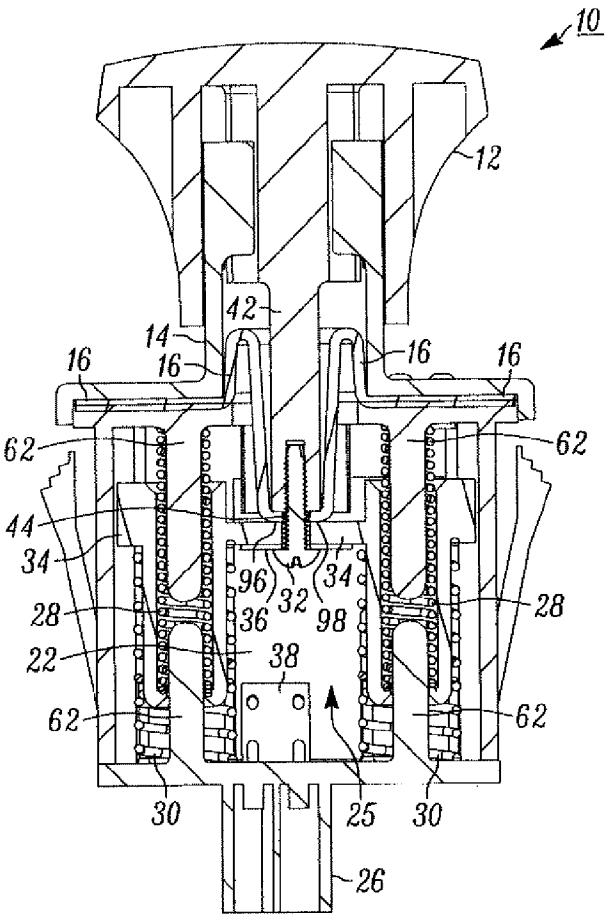
FIG. 6 is a front sectional elevation view of FIG. 1 about section lines 6-6 illustrated in FIG. 4.
Figure 9:
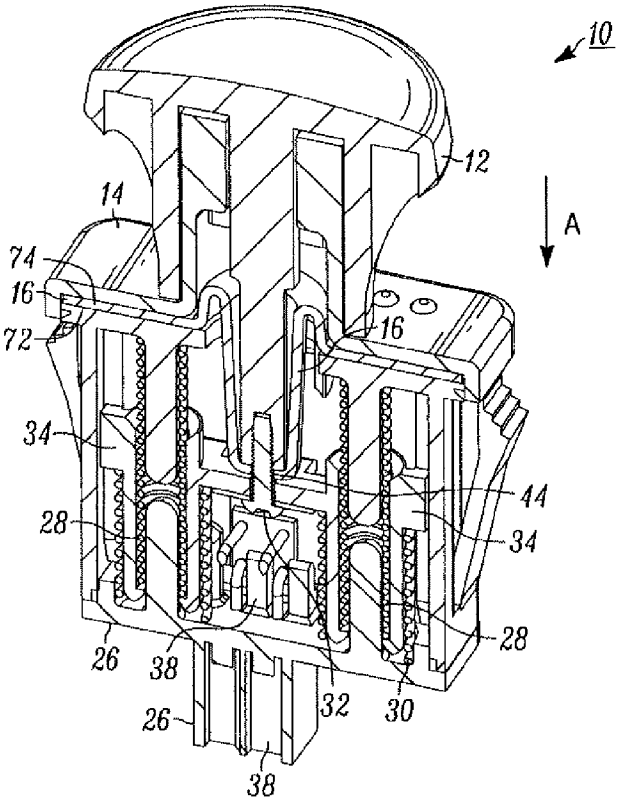
FIG. 9 is a sectional perspective view of FIG. 6, illustrating the plunger switch assembly in a first actuation position.

The first and second biasing members 28, and 30, are in the example embodiment metal coil springs forming a portion of the actuator assembly 20. The biasing members 28, 30 are symmetrically supported within the actuator assembly 20 by a contact support 34. The contact support 34 translates within the housing 18 when the knob 12 is actuated between various positions. In the illustrated example embodiment, the contact support 34 is made of plastic and is held in a natural or in situ position by the biasing members 28 and 30, as illustrated in FIGS. 6, 7, and 9.

Figure 10:
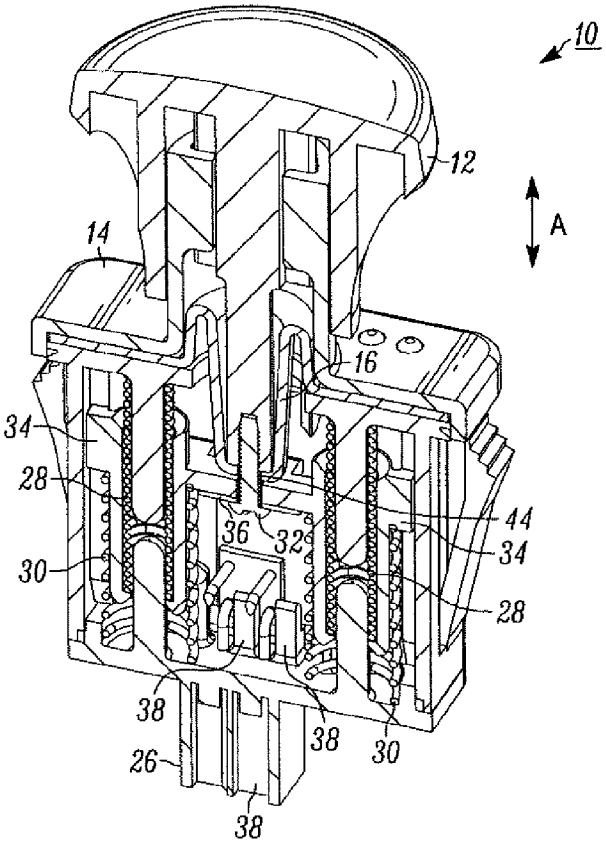
FIG. 10 is a sectional perspective view of FIG. 6, illustrating the plunger switch assembly in a second actuation position.
Figure 11:
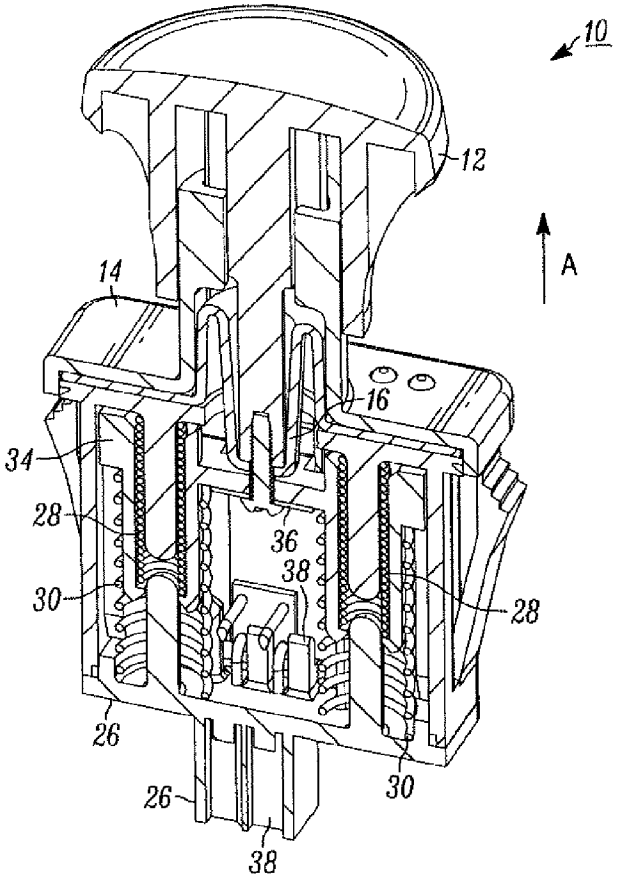
FIG. 11 is a sectional perspective view of FIG. 6, illustrating the plunger switch assembly in a third actuation position.
Figure 12:
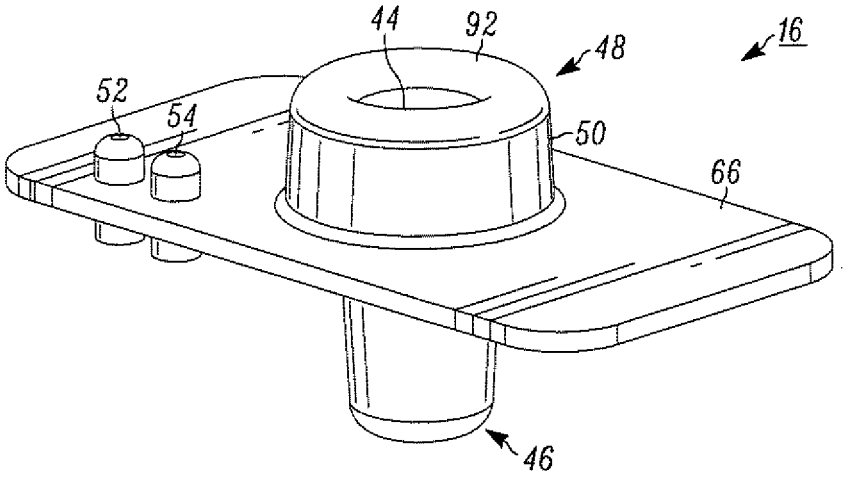
FIG. 12 is a upper perspective view of an active sealing arrangement constructed in accordance with one example embodiment of the present disclosure.

Secured to the contact support 34 is the contact bridge 24 having one or more contacts or leads 40. The contact bridge 24 is translated with the contact support 34 as the knob 12 is moved between different positions, as illustrated in FIGS. 9-11. As the contact support 34 and contact bridge 24 are translated to different positions, a plurality of similar or different length and spaced contacts or wipers 40 secured to the contact support by fastener 32 and are equally moved between the different positions and engage or wipe harness terminals or leads 38 fused to the PCB 22.

Figure 8:
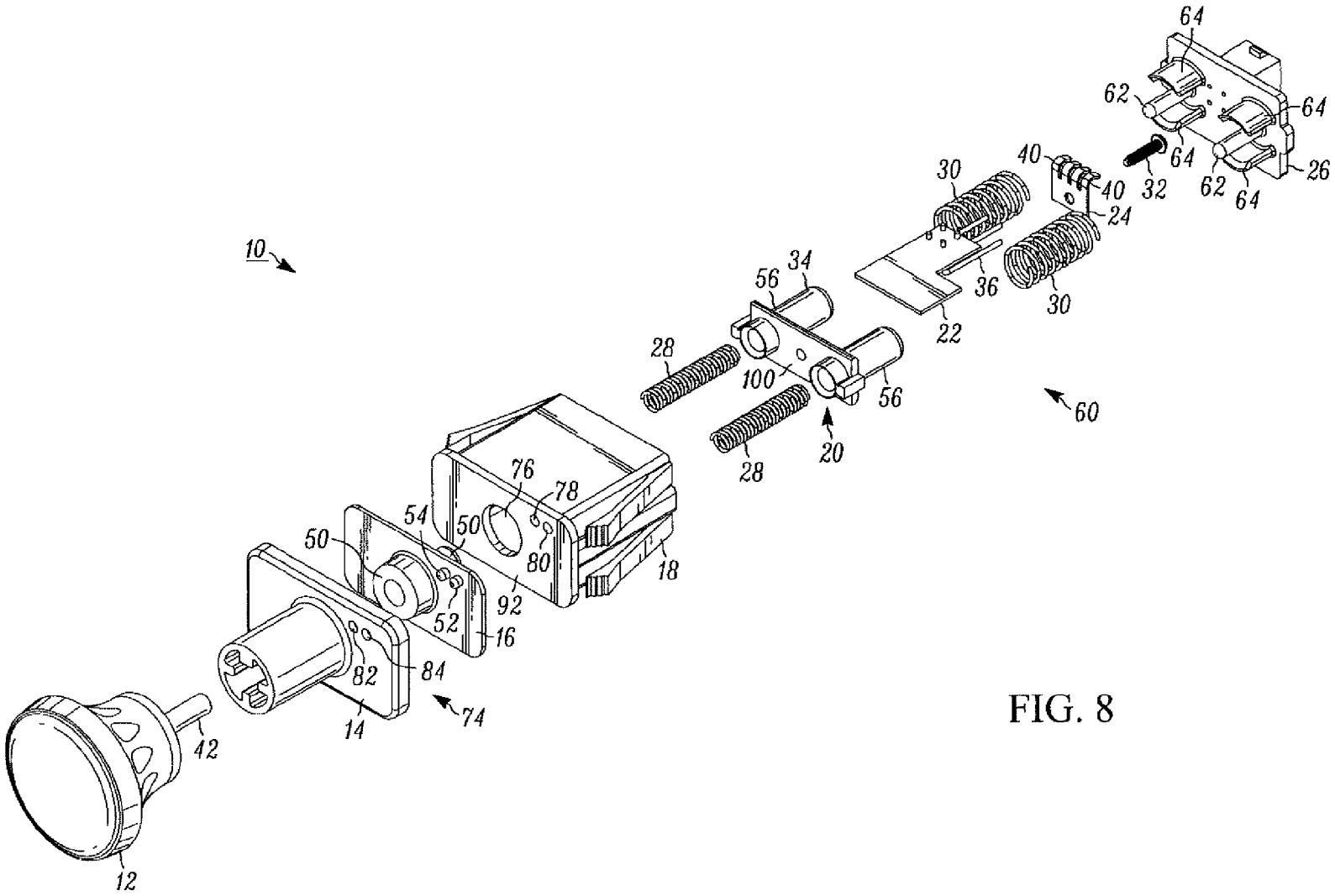
FIG. 8 is an exploded assembly view of FIG. 1.

In one example embodiment, the contacts 36 on the PCB 22 are in communication with terminals 38 and fix the PCB to the base 26 through corresponding openings as illustrated in FIG. 8. The leads 40, contacts 36, and terminals 38 are arranged to provide pre-determined electrical continuity in a plurality of switch positions (FIGS. 9-11), i.e. multiple poles/or throws. Stated another way, as the spaced contacts 40 move between the different positions of FIGS. 9-11, different harness terminals 38 are opened and/or closed in the switch 10, dependent on the construct of the PCB 22 and the connections to a wiring harness (not shown), as would be appreciated by those of ordinary skill in the art.

In one example embodiment, the PCB 22 can be unpopulated such that the switch 10 provides contact closure, or can be populated to provide an electronic interface, such as open collector input, local interconnect network (LIN), or controller area network (CAN) bus, and the like. The PCB 22 in yet another example embodiment supports a light emitting diode (LED) to provide an indication for switch position or machine state. In the illustrated example embodiment, the LED emits light through any combination of light pipes 52, 54, that are fixedly positioned within the active sealing arrangement 16. In one example embodiment, the light pipes 52, 54 are cylindrical translucent plastic rods.

It should be appreciated by those skilled in the art that the plunger switch assembly 10 in one example embodiment has a plurality of momentary and non-momentary positions. For momentary positions, cantilever supports 56 keep the switch 10 in the non-momentary position or second position, as illustrated in FIG. 10. The second or non-momentary position is located between a down or first position shown by arrow A in FIG. 9 and an up or third position illustrated by arrow A in FIG. 11. During movement of the switch assembly 10 between first and third positions, moving components 60 are translated comprising the knob 12, bellows 50, actuator assembly 20, contact bridge 24, contacts 40, and fastener 32.

In the non-momentary position, the cantilever supports 56 are supported by biasing members 28, 30, to limit vibration/bounce until an external force is applied (by a user translating the knob 12 in either the first or third directions), which results in a deflection of the supports 56. The moving components 60 and particularly the cantilever supports 56 are returned to the non-momentary or second position upon removal of the external force.

Thus, as the moving components 60 are translated between the first and second positions, the desired state of the switch 10 is changed, i.e. from open, closed etc. The construct of the switch assembly 10, and particularly the biasing members 28, 30 and their arrangement and support of the leads 40 that engage the PCB 22, minimizes vibration to the switch and advantageously adds to a longer life cycle of the electrical components associated with the PCB. Such construction also limits oscillation and unintended actuation of the switch 10.

As the bridge contact 24 moves, the leads 40 engage and/or disengage traces 36 on the PCB 22 that is fixed in the base 26. The traces 36 are in communication with terminals 38 that are electrically coupled to a wiring harness (not shown) as the knob 12 moves between the positions of FIGS. 9-11. The contact bridge 24 is connected by the fastener 32 to a threaded connection or tapped opening in the bottom of a post 42 molded into the knob 12. The fastener 32 passes through the bridge contact 24, contact support 34, and an aperture 44 located in a bottom portion 46 and extending opposite to an upper portion 48 of a bellows 50.

In an alternative example embodiment, the aperture 44 stretches to surround and fixedly attached to the post 42 in a compression fit of the bellows 50 about the post. Thus, in such an example embodiment, the need for the fastener 32 for attaching the bellows 50 to the post 42 is avoided.

Biasing members 28 are retained by spaced cantilever supports 56 and upper and lower rods 62 molded within the housing 18 and base 26. While biasing members 30 are supported by sleeves 64 projecting from the base 26 and surround cantilever supports 56.

Conventional plunger switches are prone to ingestion of water and debris. This presents problems when the wetting current is below one (1) amp (A), as second-generation plungers switches are being designed to operate with lower power requirements. At wetting currents below one (1) amp (A), break through contact with the presence of debris typically increases failure rates in conventional switches. Thus, the need for better sealing constructions in second-generation plunger switches to resist the infiltration of debris and water.

As such, the plunger switch assembly 10 provides environmental sealing capability through the active sealing arrangement 16 to keep the electrical components, including the PCB 22 and contacts 36 advantageously free from water and debris for low amperage (one (1) amp (A)) applications of the present disclosure. In particular, the design of the active sealing arrangement 16 is constructed to keep the electrical components within the housing 18 environmentally sealed by being expandable and adaptable to interface with low current applications, such as CAN or LIN bus systems.

In the example embodiment of FIGS. 12-18, the active sealing arrangement 16 includes a substantially planar member 66 having upper and lower planer sides 68, 70, respectively. Supported substantially symmetrically within the planar member 66 is the bellows 50 that extends from the upper side 68 through the planer member and out the lower side 70. In the illustrated example embodiment, the active sealing arrangement 16 that comprises bellows 50 are made from a polymer such as a thermoplastic elastomer (TPE) or thermoset material, an elastomeric material such as silicone rubber, natural rubber, or other sealing material having similar flexibility and sealing properties.

The active sealing arrangement 16 provides a seal between two halves of the housing 18 plunger switch assembly 10. In particular, the active sealing arrangement 16 seals in addition to the connection between the housing 18 and the carriage 14, it actively seals the connection between the plunger knob 12 and the contact carrier or support 34. During assembly, the active sealing arrangement 16 is sandwiched between a top surface 72 on the housing 18 and an inner surface 74 of the carriage 14. The lower planar surface 70 engages the top surface 72 and the upper planar surface 68 contacts the inner surface 74. Bellows 50 of the active sealing arrangement 16 partially passes through an opening 76 found in the top surface 72 of the housing 18. Light pipes 52, 54 orient the seal 16 and project through corresponding receiving holes 78, 80 in the top surface 72 and receiving holes 82, 84 in passing through the carriage 14.

Figure 13:
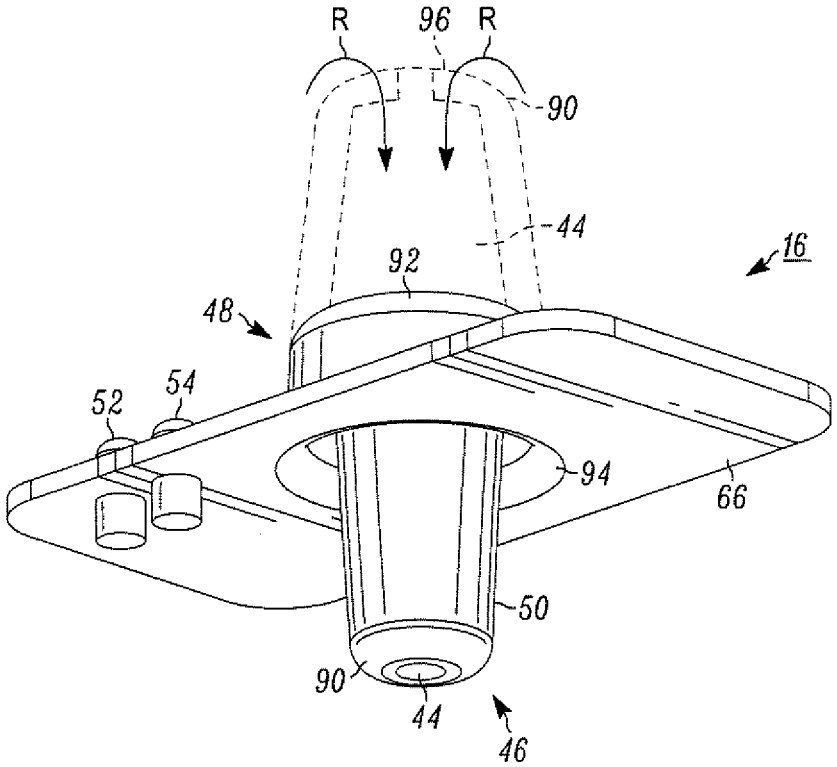
FIG. 13 is a lower perspective view of FIG. 12.
Figure 14:
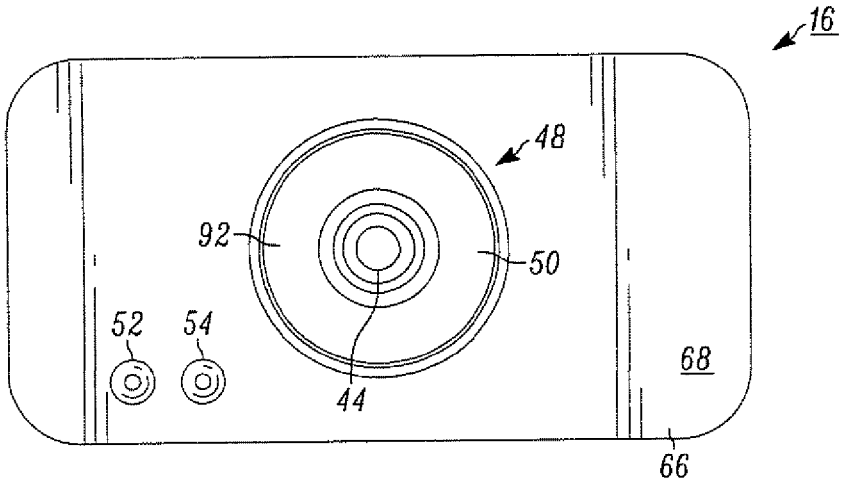
FIG. 14 is an top plan view of FIG. 12.
Figure 15:
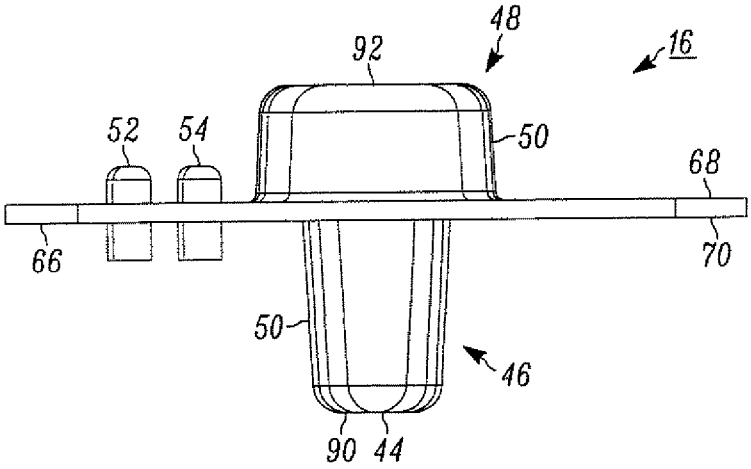
FIG. 15 is a side elevation view of FIG. 12.
Figure 16:
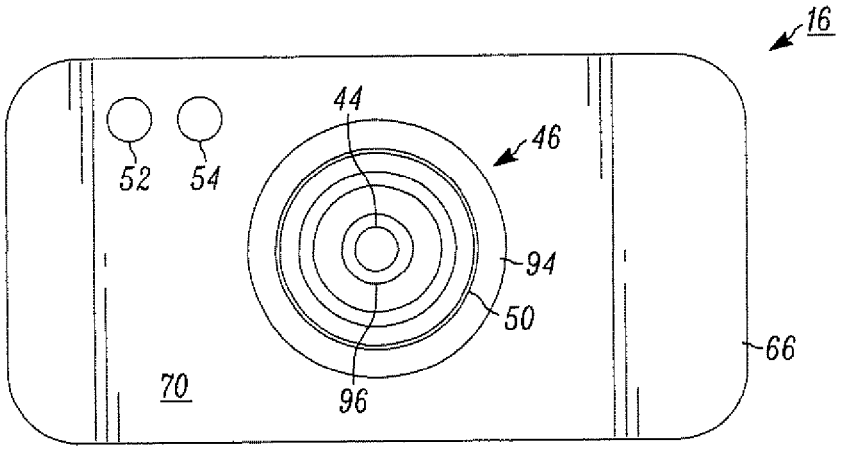
FIG. 16 is a bottom plan view of FIG. 12.
Figure 18:
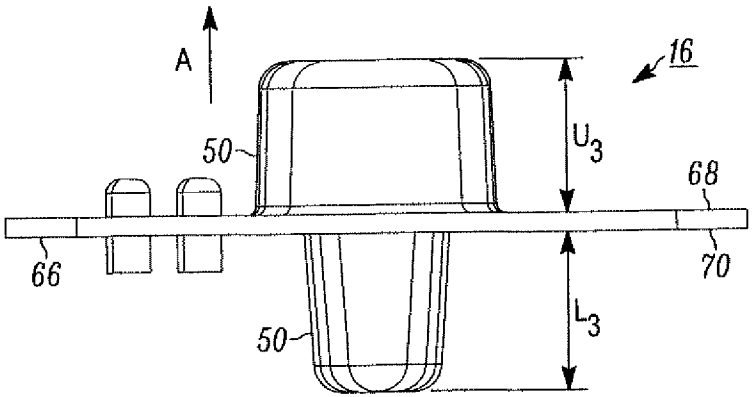
FIG. 18 is an elevation view of FIG. 12 in which the bellows member is relaxed to an in situ or first position.
Figure 17:
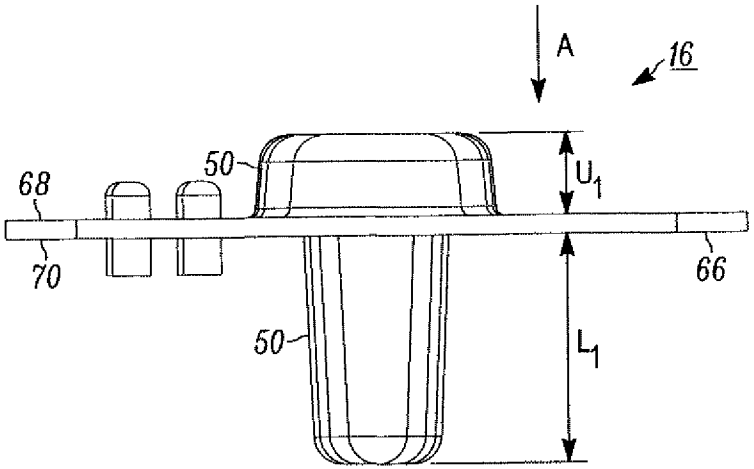
FIG. 17 is an elevation view of the FIG. 12 in which the bellows member is elongated to a extended or third position.

The bellows 50 is adaptive and expandable because it changes shape based on the position of the moving components 60 and the location of the knob 12, as illustrated in FIGS. 9-11. In FIG. 13, the construct of the bellows 50 demonstrates that its end 90 (shown in phantom originally as a coned shaped bellows) is rolled inward in the direction of arrows R through the central aperture 44 until being positioned at a location beneath the planar member 66, forming rolling end 92. The planar member 66 includes a clearance opening 94 that allows the bellows 50 to pass back and forth through the planar member without interference.

Located at the bottom portion 46 of the bellows 50 and within the central aperture 44 is an annular flange 96. The annular flange 96 is pinched between a bottom 98 of the post 42 and a plate 100 supporting the cantilever members 56 of the contact support 34. In one example embodiment, the active sealing arrangement 16 that includes bellows 50 and light pipes 52, 54 is molded as a single unitary member. In an alternative example embodiment, the bellows 50 and light pipes 52, 54 are separately molded and secured into the planar member 66.

The active sealing arrangement 16 construction and method of operation as discussed below, advantageously in addition to providing enhanced sealing protection from contaminates, reduces the activation force required to operate the plunger switch assembly 10 when compared to a traditional seal such as an o-ring. This is because the active sealing arrangement 16 advantageously moves with the post 42, knob 12, and moving components 60 instead of having a friction engagement required by an o-ring sealing connection.

During operation, the active sealing arrangement 16 is active because it both expands and contracts in the same direction but opposite the planar member 66. That is, if the plunger switch assembly 10 (and moving components) is being actuated to the first position (downward as shown by arrow A in FIG. 9), the bellows 50 is expanded (downwardly) below the planar member 66 and contracted (downwardly) above the planar member as illustrated by arrows L1 and U1, respectively in FIG. 17. Alternatively, if the plunger switch assembly 10 is being actuated to the third position (upward as shown by arrow A in FIG. 11), the bellows 50 is contracted (upwardly) below the planar member 66 and expanded (upwardly) above the planar member as illustrated by arrows L3 and U3, respectively in FIG. 18. As can be seen in FIGS. 9-11, the active sealing arrangement 16 rolls inside the central aperture 44 during a downward motion and outside the central aperture during an upward motion of the moving components 60.

In one example embodiment, the bellows 50 and its active movement is fixed within the planar member 66. That is, the bellows as it moves from various positions shown in FIGS. 9-11 and 17-18, its outer diameter remains stationary at the planar member 66.

As used herein, terms of orientation and/or direction such as upward, downward, forward, rearward, upper, lower, inward, outward, inwardly, outwardly, horizontal, horizontally, vertical, vertically, distal, proximal, axially, radially, etc., are provided for convenience purposes and relate generally to the orientation shown in the Figures and/or discussed in the Detailed Description. Such orientation/direction terms are not intended to limit the scope of the present disclosure, this application and the invention or inventions described therein, or the claims appended hereto.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications, and variations that fall within the spirit and scope of the appended claims.

What is claimed is:

1. A switch assembly comprising:

a housing having an interior cavity for locating at least one of electronic and mechanical components;

a contact support movably located within said interior cavity, the contact support for holding and moving at least one electrical contact that engages a corresponding contact located on a printed circuit board;

an actuating member for moving said contact support and at least one contact within said interior cavity of said housing;

a carriage cover located over said housing for guiding said actuating member; and an active sealing arrangement extending between said carriage cover and said housing for preventing debris from entering said housing, wherein said active sealing arrangement comprises a bellows that expands and contracts as the actuating member is moved from a first position to a second position, and wherein said active sealing arrangement further comprises a planar member integrally connected to said bellows comprising a conically shaped appendage having a central aperture that passes through the conically shaped appendage from a first side of said planar member to a second side opposite said first side of said planar member.

2. The switch assembly of claim 1 further comprising at least one light pipe for passing of illumination from said printed circuit board and interior cavity to an area located outside of said housing.

3. The switch assembly of claim 2 wherein said at least one light pipe is integrally located within said active sealing arrangement.

4. The switch assembly of claim 1 wherein said contact support includes first and second sides, wherein said first side is engaged by a first biasing member and said second side is engaged by a second biasing member, wherein said first and second biasing members prevent unintended oscillation or unintended activation of said switch assembly during use.

5. The switch assembly of claim 1 further wherein said planar member further comprises a clearance opening for the passage of said conically shaped appendage from said first side to said second side of said planar member.

6. The switch assembly of claim 5 wherein said conically shaped appendage is integrally connected to said planar member on one of said first and second sides.

7. The switch assembly of claim 1, wherein the actuating member is spaced from the contact support.

8. A switch assembly comprising:

a housing having an interior cavity for locating at least one of electronic and mechanical components;

a contact support movably located within said interior cavity, the contact support for holding and moving at least one electrical contact that selectively electrically communicates with a corresponding region on a printed circuit board, the printed circuit board being fixedly located in a base of said housing;

an actuating member for moving said contact support and said at least one contact within said interior cavity of said housing such that said moving results in selective communication with said printed circuit board;

a carriage cover located over said housing for guiding said actuating member; and a polymeric active sealing arrangement for preventing debris from entering said housing comprising a bellows that expands and contracts as the actuating member is moved from a first position to a second position, said bellows being held between an axial end face of said actuating member and said contact support, wherein said active sealing arrangement further comprises a planar member integrally connected to said bellows comprising a conically shaped appendage having a central aperture that passes through the conically shaped appendage from a first side of said planar member to a second side opposite said first side of said planar member.

9. The switch assembly of claim 8 further comprising at least one light pipe for passing of illumination from said printed circuit board and interior cavity to an area located outside of said housing.

10. The switch assembly of claim 9 wherein said at least one light pipe is integrally located within said active sealing arrangement.

11. The switch assembly of claim 8 wherein said contact support includes first and second sides, wherein said first side is engaged by a first biasing member and said second side is engaged by a second biasing member, wherein said first and second biasing members prevent unintended oscillation or unintended activation of said switch assembly during use.

12. The switch assembly of claim 8 further wherein said planar member further comprises a clearance opening for the passage of said conically shaped appendage from said first side to said second side of said planar member.

13. The switch assembly of claim 12 wherein said conically shaped member is integrally connected to said planar member on one of said first and second sides.

14. The switch assembly of claim 8, wherein the sealing arrangement extends into the housing.

15. A switch assembly comprising:

a housing having an interior cavity for locating at least one of electronic and mechanical components;

a contact support movably located within said interior cavity, the contact support for holding and moving at least one electrical contact that engages a corresponding contact located on a printed circuit board;

an actuating member for moving said contact support and at least one contact within said interior cavity of said housing;

a carriage cover located over said housing for guiding said actuating member; and an active sealing arrangement extending between said carriage cover and said housing for preventing debris from entering said housing, wherein the sealing arrangement includes a planar member sandwiched between the contact support and the housing, and a bellows extending away from the actuating member and sandwiched between the actuating member and the contact support for preventing debris from entering the housing.

16. A switch assembly comprising:

a housing having an interior cavity for locating at least one of electronic and mechanical components;

a contact support movably located within said interior cavity, the contact support for holding and moving at least one electrical contact that engages a corresponding contact located on a printed circuit board;

an actuating member for moving said contact support and at least one contact within said interior cavity of said housing;

a carriage cover located over said housing for guiding said actuating member; and an active sealing arrangement extending between said carriage cover and said housing for preventing debris from entering said housing, wherein the sealing arrangement includes a bellows that extends between the actuating member and the contact support to space the actuating member from the contact support.

* * * * *